US009257772B2

(12) United States Patent
Natter

(10) Patent No.: US 9,257,772 B2
(45) Date of Patent: Feb. 9, 2016

(54) ELECTRIC CONNECTOR WITH A LOCK TO RETAIN A TERMINAL WITHIN A HOUSING

(71) Applicant: Lear Corporation, Southfield, MI (US)

(72) Inventor: Brantley Natter, Southfield, MI (US)

(73) Assignee: Lear Corporation, Southfield, MI (US)

( * ) Notice: Subject to any disclaimer, the term of this patent is extended or adjusted under 35 U.S.C. 154(b) by 149 days.

(21) Appl. No.: 14/174,202

(22) Filed: Feb. 6, 2014

(65) Prior Publication Data

US 2014/0227913 A1 Aug. 14, 2014

Related U.S. Application Data

(60) Provisional application No. 61/762,612, filed on Feb. 8, 2013.

(51) Int. Cl.

| | |
|---|---|
| ***H01R 13/02*** | (2006.01) |
| ***H01R 13/42*** | (2006.01) |
| *H01R 13/11* | (2006.01) |
| *H01R 101/00* | (2006.01) |

(52) U.S. Cl.
CPC ..... *H01R 13/42* (2013.01); *H01R 13/113* (2013.01); *H01R 2101/00* (2013.01)

(58) Field of Classification Search
CPC ..... H01R 13/506
USPC ..... 439/686, 685, 701, 902
See application file for complete search history.

(56) References Cited

U.S. PATENT DOCUMENTS

| | | | | |
|---|---|---|---|---|
| 2,374,971 | A * | 5/1945 | Benander | H01R 13/56 174/59 |
| 4,109,992 | A * | 8/1978 | Hughes | H01R 13/567 439/620.21 |
| 4,869,686 | A | 9/1989 | Michaels et al. | |
| 6,030,256 | A * | 2/2000 | Cappe | H01R 13/506 439/598 |
| 6,068,502 | A * | 5/2000 | Kuo | H01R 12/7023 439/353 |
| 6,099,358 | A * | 8/2000 | Sugiyama | H01R 11/22 439/686 |
| 6,276,960 | B1 * | 8/2001 | Schaefer | H01R 11/287 439/466 |
| 6,325,661 | B1 * | 12/2001 | Tabata | H01R 13/5205 439/459 |
| 6,821,160 | B2 * | 11/2004 | Fink | H01R 13/512 439/595 |
| 7,241,183 | B2 * | 7/2007 | Wasalaski | H01R 13/447 439/686 |
| 7,438,594 | B2 * | 10/2008 | Natter | H01R 13/4361 439/352 |
| 8,192,229 | B2 * | 6/2012 | Endo | H01R 13/501 439/596 |
| 8,597,062 | B2 * | 12/2013 | Casses | H01R 4/184 439/686 |
| 9,209,582 | B2 * | 12/2015 | Kashiwada | H01R 24/76 |
| 2014/0227913 | A1 * | 8/2014 | Natter | H01R 13/42 439/725 |

OTHER PUBLICATIONS

4-Way 14.5HV Connector Assembly Instructions, published before Feb. 6, 2014.

* cited by examiner

*Primary Examiner* — Neil Abrams
(74) *Attorney, Agent, or Firm* — MacMillan, Sobanski & Todd, LLC

(57) ABSTRACT

An electric connector includes an outer housing and an inner housing located within the outer housing. A connector terminal is located within the inner housing. A primary lock retains the connector terminal within the inner housing, and a secondary lock also retains the connector terminal within the inner housing.

18 Claims, 4 Drawing Sheets

ELECTRIC CONNECTOR WITH A LOCK TO RETAIN A TERMINAL WITHIN A HOUSING

CROSS-REFERENCE TO RELATED APPLICATIONS

This application claims the benefit of U.S. Provisional Application No. 61/762,612, filed Feb. 8, 2013, the disclosure of which is incorporated herein by reference.

BACKGROUND OF THE INVENTION

This invention relates in general to an electric connector and, more specifically, to an electric connector assembly that includes a terminal that is retained within a housing by a primary lock and a secondary lock.

Electric connectors may be used in automobiles, for example, in completing electrical circuits with components in a power distribution box or connecting a wiring harness to an electrical device. These connectors may include a wire that is connected to a connector terminal, and the connector terminal is designed to mate with a corresponding terminal located, for example, in the power distribution box. Some electric connectors include a connector terminal that mates with the corresponding terminal on a first axis, while the wire exits the connector on a second axis that is perpendicular to the first axis. These are known as ninety degree connectors because there is a ninety-degree angle between the terminal and the wire of the connector.

The wire is commonly connected to the connector terminal by welding an end of the wire to a portion of the connector terminal. This welding helps maintain a good connection between the wire and the connector terminal. The connector terminal is typically fixed inside a connector housing in order to help prevent damage to the electric connector and to maintain proper mating between the connector terminal and the corresponding terminal. For example, the connector terminal should not pull out of the connector housing if the wire is tugged or pulled. The terminal may be fixed inside the connector housing in part by providing a connector terminal that will engage a portion of connector housing if the connector terminal comes out of its proper position. Assembling these electric connectors can require inserting the wire end through a wire opening in the connector housing prior to welding the wire end to the connector terminal. It would be advantageous to have an electric connector that is easier to assemble.

SUMMARY OF THE INVENTION

This invention relates to an electric connector. The electric connector may have an outer housing. The electric connector may have an inner housing locating within the outer housing. A connector terminal may be located within the inner housing. A primary lock may retain the connector terminal within the inner housing. A secondary lock may retain the connector terminal within the inner housing. The electric connector may include an external electrical connection. The external electrical connection may be connected along a wire axis. The connector terminal may be positioned to mate with a corresponding terminal on a terminal axis. The wire axis and the terminal axis may be non-parallel with each other. The wire axis and the terminal axis may be generally perpendicular to each other. The outer housing may define a wire opening. The wire opening may have a height in the direction parallel to the terminal axis that is larger than the height of the connector terminal parallel to the terminal axis. The inner housing may define an inner wire opening. The connector terminal may be positioned within the inner housing through the inner wire opening. The secondary lock may include a lock wall. The secondary lock may be movable between a pre-lock position and a lock position. The lock wall may obstruct a portion of the inner wire opening when the secondary lock is in the lock position. The lock wall may not obstruct the inner wire opening when the secondary lock is in the pre-lock position. The inner housing may define a lock slot. When the secondary lock is in the lock position, the lock wall may be located in the lock slot. When the secondary lock is in the pre-lock position, the lock wall may be not located in the lock slot. The lock slot may be located a recess distance from the wire opening. The primary lock may include a resilient arm attached to the inner housing. The primary lock may include a hook that engages an outer edge of the connector terminal.

Various aspects of this invention will become apparent to those skilled in the art from the following detailed description of the preferred embodiment, when read in light of the accompanying drawings.

DETAILED DESCRIPTION OF THE PREFERRED EMBODIMENT

Figure 1:
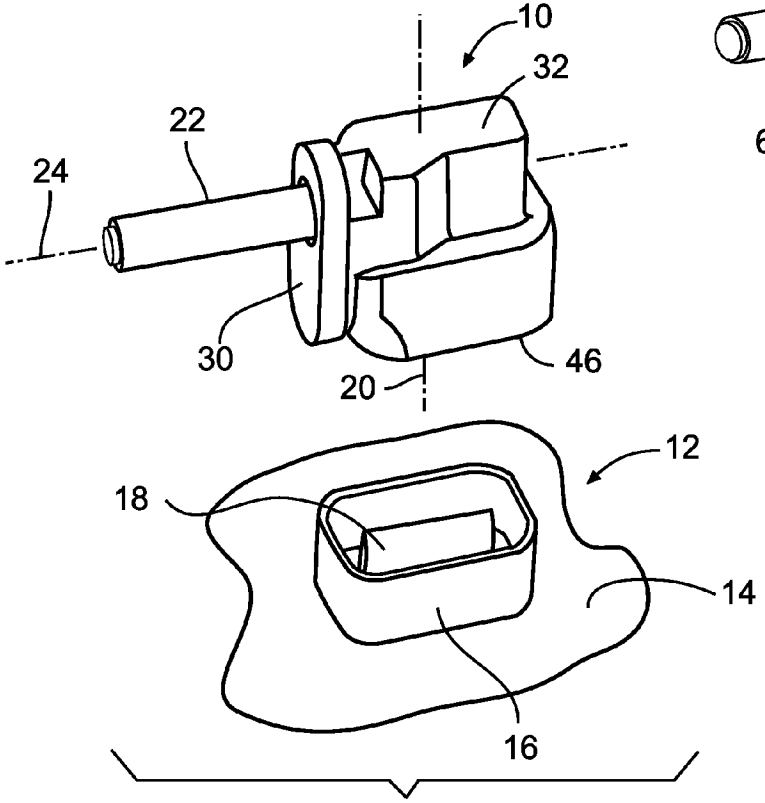
FIG. 1 is a perspective view of an electric connector and a corresponding terminal on an electric device.

Referring now to the drawings, there is illustrated in FIG. 1 an electric connector, indicated generally at 10. The electric connector 10 is configured to mate with a corresponding connector 12 located on an electric device 14. The electric device 12 can be any desired electric component such as an electric vehicle battery. The corresponding connector 12 includes a header 16 and a corresponding terminal 18. The illustrated corresponding terminal 18 is a male blade terminal, but it may be any desired type of terminal.

The illustrated electric connector 10 is a ninety-degree connector. The electric connector 10 is configured to mate with the corresponding connector 12 along a terminal axis 20 while a wire 22 is connected to the electric connector 10 along a wire axis 24 that is generally perpendicular to the terminal axis 20. It should be appreciated that the terminal axis 20 and the wire axis 24 may have some other relative orientation, if desired. For example, the terminal axis 20 and the wire axis 24 may not be perpendicular, but be separated by an angle that is either greater than or less than ninety degrees.

Figure 2:
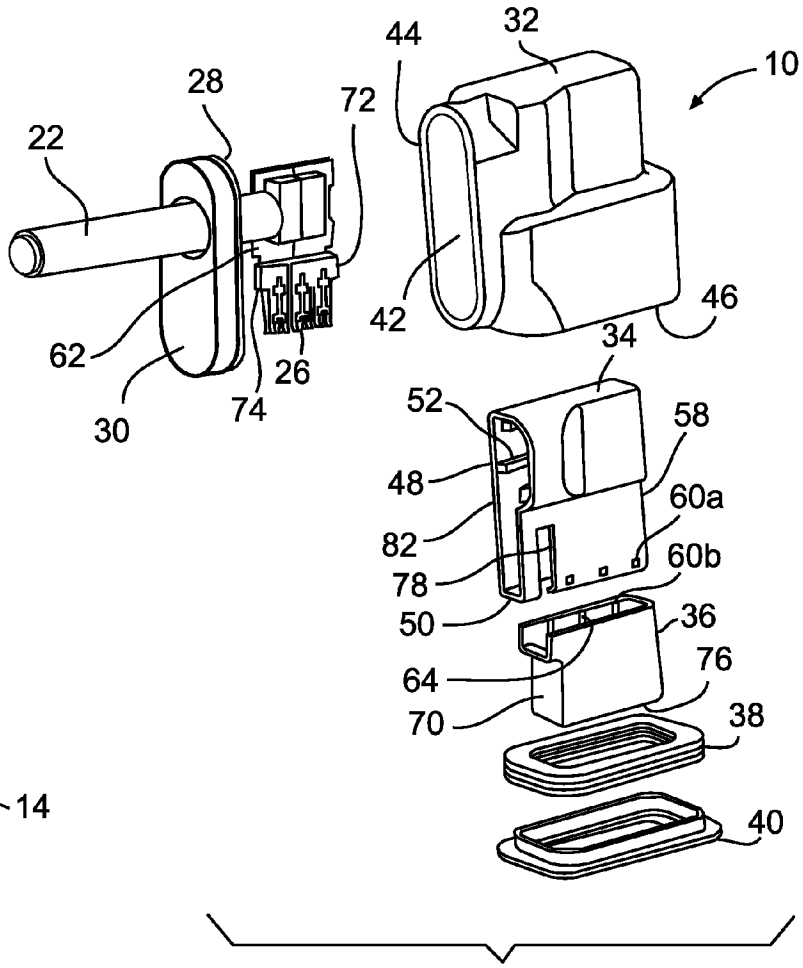
FIG. 2 is a perspective, partially exploded view of the electric connector from FIG. 1.

Referring now to FIG. 2, an exploded view of the electric connector 10 is shown. The electric connector 10 includes a connector terminal 26 that is attached to the wire 22, a wire seal 28, a wire seal retainer 30, an outer housing 32, an inner housing 34, a lock member 36, a housing seal 38, and a housing seal retainer 40. Each of these components will be described below.

The connector terminal 26 is the electric terminal that mates with the corresponding terminal 18 when the electric connector 10 is mated with the corresponding connector 12. The illustrated connector terminal 26 is a female electrical terminal, but it may be any desired terminal that is compatible with the corresponding terminal 18. The wire 22 is welded to the connector terminal 26, but the wire can be connected to the connector terminal 26 using any other desired method. Further, it should be appreciated that the wire 22 may be replaced with any other external electrical connection or some other desired component such as, for example, another electric terminal.

The optional wire seal 28 provides a seal between the wire 22 and the outer housing 32. The illustrated wire seal 28 is made of an elastomeric material, but it may be made of any desired material. The wire seal 28 helps to isolate an interior space 42 of the outer housing 32 when the electric connector 10 is assembled, as will be described below. The wire seal 28 is disposed around the wire 22 and is designed to be positioned in an outer wire opening 44 defined by the outer housing 32 when the electric connector 10 is assembled. When the electric connector 10 is assembled, the wire seal retainer 30 is attached to the outer housing 32 over the outer wire opening 44 and serves to retain the wire seal 28 in place. The illustrated wire seal retainer 30 is made of metal, but it may be made of any desired material.

The outer housing 32 serves to contain the components of the assembled electric connector 10, as will be described below. The illustrated outer housing 32 is made of metal, but it may be made of any desired material. The outer housing 32 defines the outer wire opening 44 that is located around the wire axis 24 and an outer terminal opening 46 (on the bottom of the outer housing 32 as viewed in FIG. 1 and FIG. 2) that is located around the terminal axis 20. The outer wire opening 44 and the outer terminal opening 46 both provide access to the internal space 42 of the outer housing 32.

The inner housing 34 serves to contain the connector terminal 26 when the electric connector 10 is assembled. The illustrated inner housing 34 is made of an electrically insulating plastic, but it may be made of any desired material. The inner housing 34 defines an inner wire opening 48 that is located around the wire axis 24 and an inner terminal opening 50 that is located around the terminal axis 20 of the assembled electric connector 10.

The inner housing 34 includes optional terminal guides 52. The terminal guides 52 assist in properly positioning the connector terminal 26 when it is inserted into the inner housing 34. The illustrated terminal guides 52 are protruding ridges that are molded as part of the inner housing 34. However, any other desired mechanism may be used to assist in proper positioning of the connector terminal 26 within the inner housing 34.

Figure 3:
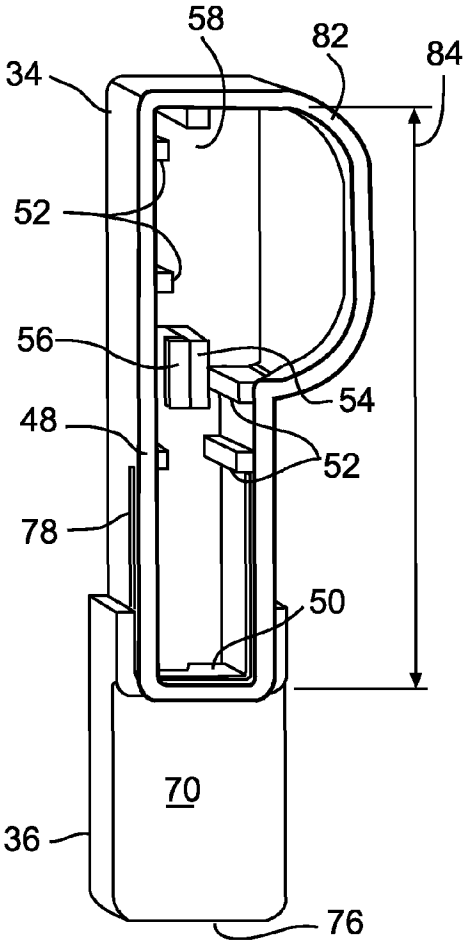
FIG. 3 is a view from the side of an inner housing of the electric connector showing a lock member in a pre-lock position.

As best seen in FIG. 3, the inner housing 34 includes a retainer arm 54 with a hook 56. The retainer arm 54 is a primary lock that retains the connector terminal 26 within the inner housing 34. The illustrated retainer arm 54 is made of resilient plastic and is attached to a back wall 58 of the inner housing 34. However, the retainer arm 54 may be made of other desired material and may be connected to the inner housing 34 in a different manner, if desired. Further, it should be appreciated that the retainer arm 54 may be replaced with any other desired primary lock that retains the connector terminal 26 within the inner housing 34.

The lock member 36 is a secondary lock that also retains the connector terminal 26 within the inner housing 34. The illustrated lock member 36 is made of an electrically insulating plastic, but may be made of any desired material.

To assemble the electric connector 10, the lock member 36 is placed in a pre-lock position relative to the inner housing 34, shown in FIG. 3. Optional pre-lock features 60*a* and 60*b* may be respectively provided on the inner housing 34 and the lock member 36, respectively (best seen in FIG. 2) to retain the lock member 36 in the pre-lock position. The illustrated pre-lock features 60*a* and 60*b* may be formed as cooperating tabs on the exterior of the inner housing 34 and the interior of the lock member 36. However, any desired cooperating features may be used to retain the lock member 36 in the pre-lock position. As shown in FIG. 3, when the lock member 36 is in the pre-lock position, it does not obstruct the inner wire opening 48.

Figure 4:
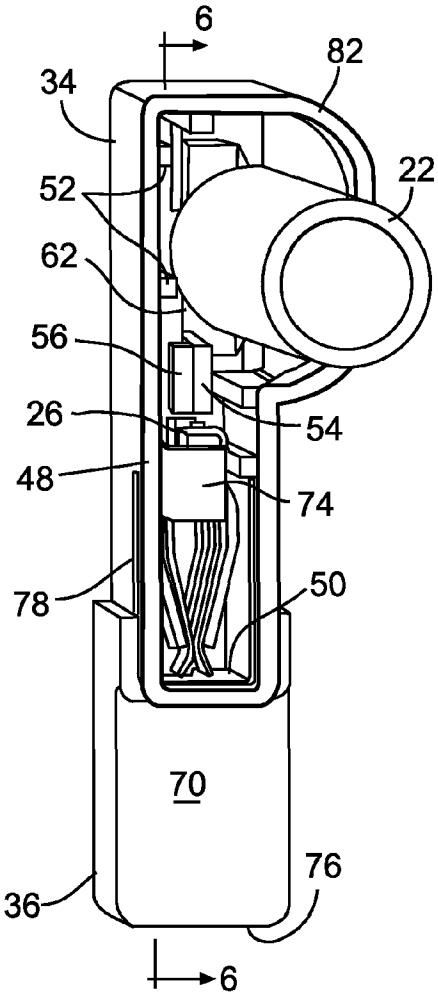
FIG. 4 is a view similar to FIG. 3, showing a connector terminal positioned inside the inner housing.

The connector terminal 26 may be moved through the inner wire opening 48 into the inner housing 34. The connector terminal 26 will engage the hook 56 so the retainer arm 54 is deflected to an insertion position, allowing the connector terminal 26 to be moved past the hook 56. When the connector terminal 26 is within the inner housing 36, the retainer arm 54 deflects back to a lock position, shown in FIG. 4. In the lock position, the hook 56 engages an outer edge 62 of the connector terminal 26 in order to prevent the connector terminal 26 from moving out of the inner housing 34 through the inner wire opening 48.

Figure 5:
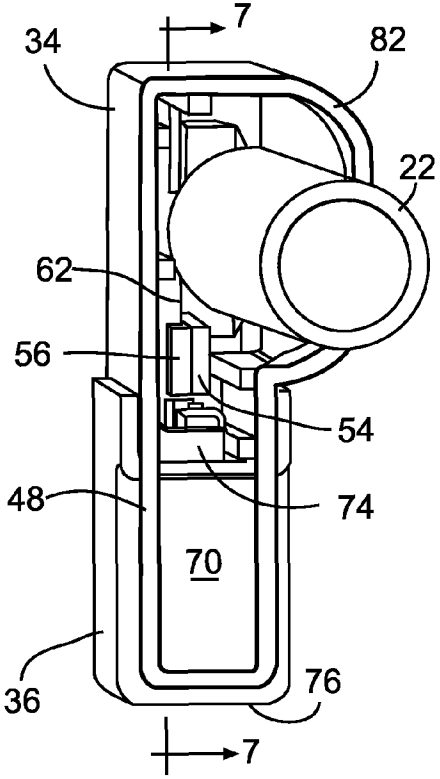
FIG. 5 is a view similar to FIG. 4, showing the lock member in a lock position.
Figure 6:
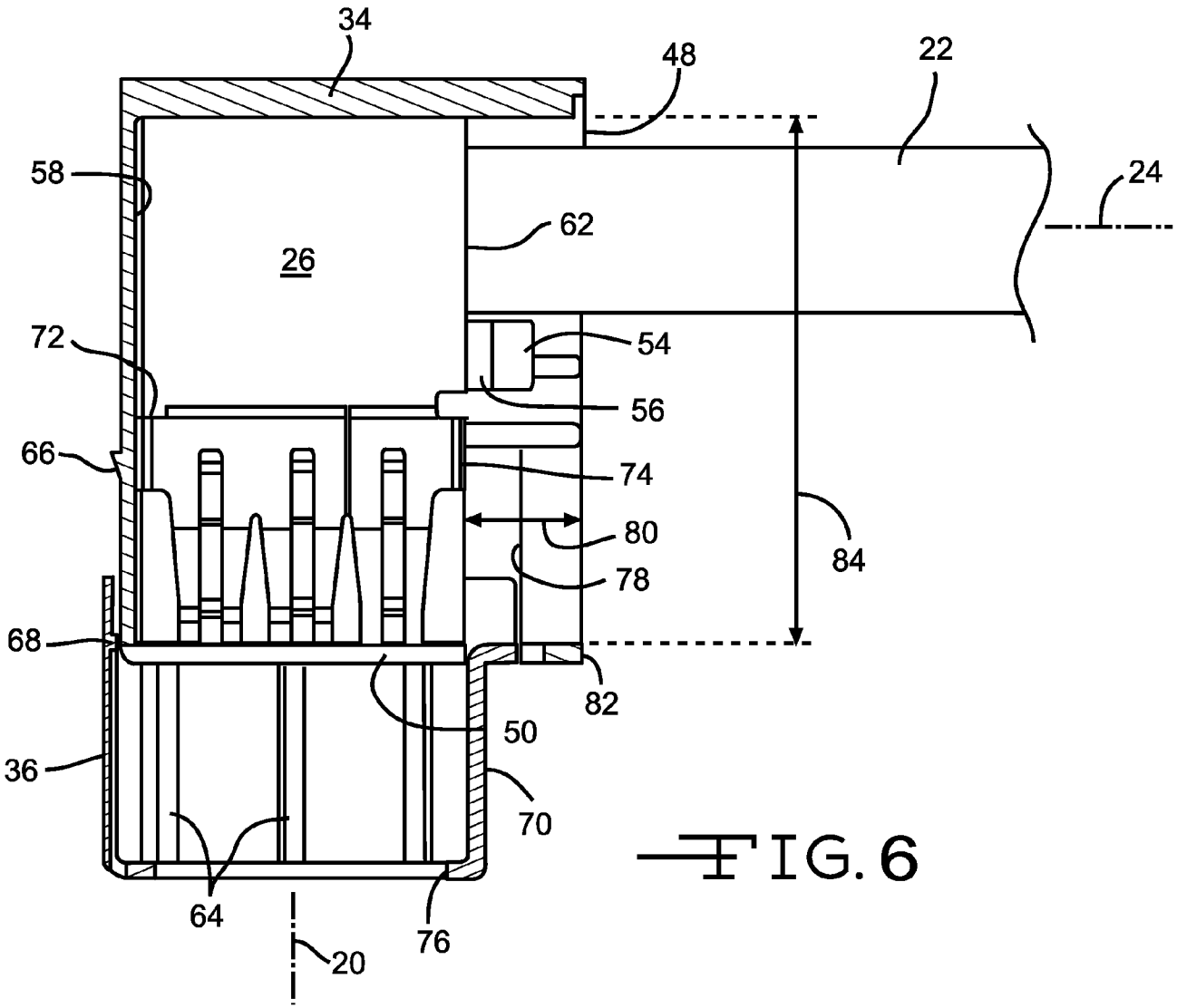
FIG. 6 is a cross-sectional view taken along the line 6-6 of FIG. 4.
Figure 7:
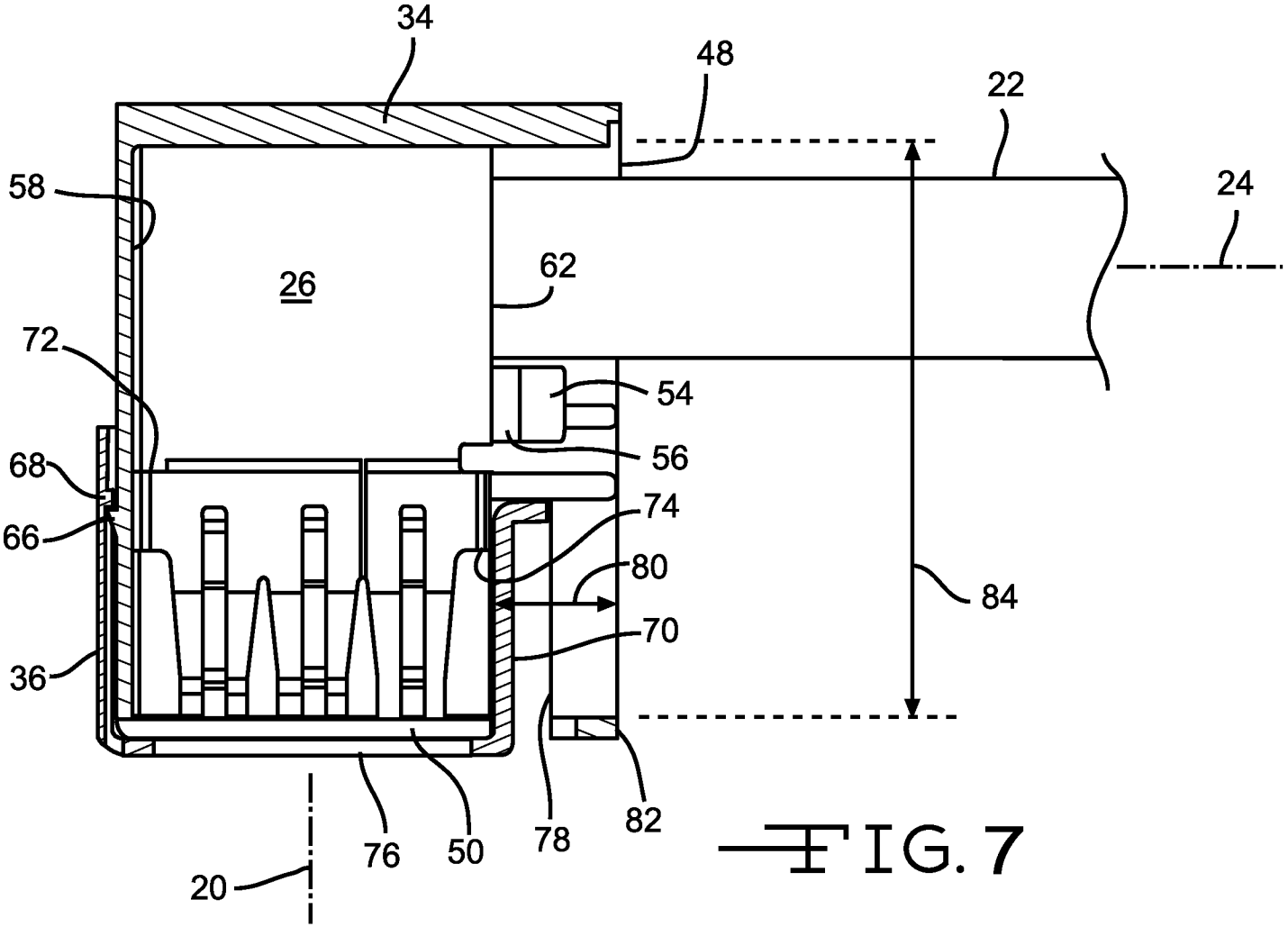
FIG. 7 is a cross-sectional view taken along the line 7-7 of FIG. 5.

As shown in FIG. 5, the lock member 36 is moved relative to the inner housing 34 to a lock position. Best seen in FIG. 2, the optional pre-lock features 60*a* on the exterior of the inner housing 34 cooperate with channels 64 on the interior of the lock member 36 to assist in properly positioning the lock member 36 relative to the inner housing 34. It should be appreciated that any desired cooperating feature may be used to assist in properly positioning the lock member 36 relative to the inner housing 34. As best seen in FIG. 6 and FIG. 7, cooperating lock features 66 and 68 may be respectively provided on the inner housing 34 and the lock member 36 to retain the lock member 36 in the lock position. The illustrated lock features 66 and 68 are cooperating tabs on the exterior of the inner housing 34 and the interior of the lock member 36. However, any desired cooperating features may be used to retain the lock member 36 in the lock position.

As shown in FIG. 5, when the lock member 36 is in the lock position, it will interfere with the connector terminal 26 being moved out of the inner housing 34 through the inner wire opening 48. The lock member 36 includes a lock wall 70 that partially obstructs the inner wire opening 48 in order to prevent the connector terminal 26 from being removed from the inner housing 34.

As best seen in FIG. 6 and FIG. 7, the connector terminal 26 includes a housing engagement end 72 that engages the inner housing 34 and a lock engagement end 74 that engages the lock wall 70. The engagement of the connector terminal 26 helps to keep the connector terminal 26 in a fixed position within the inner housing 34 for proper engagement with the corresponding terminal 18. The lock member 36 defines a lock terminal opening 76 that aligns with the inner terminal opening 50 in order to allow the corresponding terminal 18 to mate with the connector terminal 26 when the electric connector 10 is assembled.

As best seen in FIG. 2, FIG. 6, and FIG. 7, the inner housing 34 defines an optional lock slot 78. The lock slot 78 is located a recess distance 80 (see FIG. 6 and FIG. 7) from a housing edge 82 of the inner housing 34. It should be appreciated that the housing edge 82 is the edge of the inner housing 34 that defines the inner wire opening 48. The lock wall 70 of the lock member 36 is positioned within the lock slot 78 when the lock member 36 is in the lock position. Therefore, the lock engagement end 74 of the connector terminal 26 is located the recess distance 80 from the housing edge 82. The size of the recess distance 80 may be selected to provide additional insulation or protection for the connector terminal 26.

The lock member 36 also serves to provide an indicator if the connector terminal 26 is not properly positioned within the inner housing 34. During assembly, it is possible that the connector terminal 26 may not be fully inserted into the inner housing 34. In such a case, it should be appreciated that when the lock member 36 is moved from the pre-lock position (shown in FIG. 6) toward the lock position (shown in FIG. 7), the lock member 36 may engage the connector terminal 26 before reaching the lock position. The failure of the lock member 36 to reach the lock position would provide an indication that the connector terminal 26 is not properly positioned within the inner housing 32.

With the connector terminal 26 located inside the inner housing 34 and the lock member 36 in the lock position, as shown in FIG. 5, the inner housing 34 may be positioned inside the outer housing 32. The inner housing 34 may be inserted through the outer wire opening 44. The outer wire opening 44 has an opening height 84, parallel to the terminal axis 20, which is larger than the height of the connector terminal 26, as well as the height of the inner housing 34 in the direction parallel to the terminal axis 20. The outer wire opening 44 is large enough that the inner housing 34, including the connector terminal 26 and the attached wire 22, may be inserted through the outer wire opening 44. It should be appreciated that this allows the wire 22 to be welded to the connector terminal 26 before the wire 22 is inserted into the outer housing 32. The inner housing 34 may be retained within the interior space 42 of the outer housing 32 by press fit, adhesives, or any other desired method. The wire seal 28 and the wire seal retainer 30, and the optional housing seal 38 and the housing seal retainer 40, may be connected to complete the electric connector 10.

The illustrated housing seal 38 is an elastomeric material that provides a seal between the outer housing 32 and the header 16 when the electric connector 10 is attached to the electric device 14. The housing seal 38 may be made of any desired material. The housing seal 38 helps to isolate the interior space 42 of the outer housing 32 when the electric connector 10 is connected to the electric device 14. It should be appreciated that the wire seal 28 and the housing seal 38 help to keep dirt, water, and other material out of the interior space 42 of the outer housing 32 in order to help protect the connector terminal 26 and the corresponding terminal 18 from corrosion or other damage when the electric connector 10 is installed.

The housing seal retainer 40 is attached to the outer housing 32 at the outer terminal opening 46 and serves to retain the housing seal 38 in place. The illustrated housing seal retainer 40 is made of metal, but may be made of any desired material.

It should be appreciated that because the illustrated outer housing 32 and the illustrated wire seal retainer 30 are made of metal, they provide electromagnetic shielding around the connector terminal 26 and the mated corresponding terminal 18. However, as previously described, the outer housing 32 and the wire seal retainer 30 may be made of any desired materials.

The principle and mode of operation of this invention have been explained and illustrated in its preferred embodiment. However, it must be understood that this invention may be practiced otherwise than as specifically explained and illustrated without departing from its spirit or scope.

What is claimed is:

1. An electric connector comprising:

an outer housing;

an inner housing located within the outer housing;

a connector terminal located within the inner housing;

a primary lock retaining the connector terminal within the inner housing;

a secondary lock retaining the connector terminal within the inner housing, wherein:

the inner housing defines a wire opening and the connector terminal is positioned within the inner housing through the wire opening;

the secondary lock includes a lock wall;

the secondary lock may be moved between a pre-lock position, wherein the lock wall does not obstruct the wire opening, and a lock position, wherein the lock wall does obstruct a portion of the wire opening; and wherein either:

(1) the inner housing defines a lock slot, and when the secondary lock is in the lock position, the lock wall is located in the lock slot; or (2) a resilient arm is attached to the inner housing.

2. The electric connector of claim 1, further comprising an external electrical connection that is connected to the electric connector along a wire axis; wherein the connector terminal is positioned to mate with a corresponding terminal on a terminal axis; and wherein the terminal axis and the wire axis are not parallel.

3. The electric connector of claim 2, wherein the terminal axis is generally perpendicular to the wire axis.

4. The electric connector of claim 3, wherein the outer housing defines a wire opening that has a height parallel to the terminal axis that is larger than the height of the connector terminal parallel to the terminal axis.

5. The electric connector of claim 1, wherein the inner housing defines a lock slot, and wherein when the secondary lock is in the lock position, the lock wall is located in the lock slot.

6. The electric connector of claim 5, wherein when the secondary lock is in the pre-lock position, the lock wall is not located in the lock slot.

7. The electric connector of claim 6, wherein the lock slot is located a recess distance from the wire opening.

8. The electric connector of claim 5, wherein the lock slot is located a recess distance from the wire opening.

9. The electric connector of claim 1, wherein the resilient arm is attached to the inner housing.

10. The electric connector of claim 9, wherein the primary lock includes a hook that engages an outer edge of the connector terminal.

11. An electric connector comprising:

a housing that defines a wire opening;

a connector terminal located within the housing and positioned to mate with a corresponding terminal on a terminal axis; and an external electrical connection that is connected to the electric connector along a wire axis; wherein:

the terminal axis is generally perpendicular to the wire axis;

the wire opening has a height parallel to the terminal axis that is larger than a height of the connector terminal parallel to the terminal axis; and the housing is an outer housing, and further comprising an inner housing, wherein the inner housing defines a wire opening and the connector terminal is positioned within the inner housing through the wire opening; a primary lock retaining the connector terminal within the inner housing; and a secondary lock retaining the connector terminal within the inner housing.

12. The electric connector of claim 11, wherein the secondary lock includes a lock wall and the secondary lock may be moved between a pre-lock position, wherein the lock wall does not obstruct the wire opening, and a lock position, wherein the lock wall does obstruct a portion of the wire opening.

13. The electric connector of claim 12, wherein the inner housing defines a lock slot, and wherein when the secondary lock is in the lock position, the lock wall is located in the lock slot.

14. The electric connector of claim 13, wherein when the secondary lock is in the pre-lock position the lock wall is not located in the lock slot.

15. The electric connector of claim 13, wherein the lock slot is located a recess distance from the wire opening.

16. The electric connector of claim 15, wherein the resilient arm includes a resilient arm attached to the inner housing.

17. The electric connector of claim 16, wherein the primary lock includes a hook that engages an outer edge of the connector terminal.

18. An electric connector comprising:

an outer housing;

an inner housing located within the outer housing and defining a lock slot;

a connector terminal located within the inner housing and positioned to mate with a corresponding terminal on a terminal axis;

a primary lock including a resilient arm attached to the inner housing and a hook that engages an outer edge of the connector terminal to retain the connector terminal within the inner housing;

a secondary lock including a lock wall, the secondary lock movable between a pre-lock position, wherein the lock wall is not located in the lock slot, and a lock position, wherein the lock wall is located in the lock slot to retain the connector terminal within the inner housing; and a wire that is connected to the connector terminal along a wire axis;

wherein the terminal axis is generally perpendicular to the wire axis.

* * * * *